US005911523A

United States Patent [19]

Burchart

[11] Patent Number: 5,911,523

[45] Date of Patent: Jun. 15, 1999

[54] ADJUSTABLE DISPLAY SUPPORT

[76] Inventor: John Lewis Burchart, 8887 Woodbine St., Redford Township, Mich. 48239

[21] Appl. No.: 08/898,118

[22] Filed: Jul. 22, 1997

[51] Int. Cl.[6] ..... G09F 19/00

[52] U.S. Cl. ..... 40/406; 40/607; 248/414

[58] Field of Search ..... 40/606, 607, 612; 248/414; 403/109.3

[56] References Cited

U.S. PATENT DOCUMENTS

| | | | |
|---|---|---|---|
| 373,376 | 11/1887 | Penfield . | |
| 824,596 | 6/1906 | Smith | 248/414 X |
| 958,082 | 5/1910 | Bland | 40/606 |
| 1,309,375 | 7/1919 | Taylor . | |
| 1,769,004 | 7/1930 | Turse . | |
| 1,804,770 | 5/1931 | Hershfield | 40/606 |
| 1,924,858 | 8/1933 | Hopp | 248/414 |
| 2,468,160 | 4/1949 | Benson . | |
| 2,636,112 | 4/1953 | Dvorsky | 248/414 X |
| 4,777,750 | 10/1988 | Garfinkle | 40/607 |

*Primary Examiner*—Brian K. Green
*Attorney, Agent, or Firm*—Tom Hammil, Jr.

[57] ABSTRACT

An improved adjustable display support is disclosed wherein a pair of coaxially telescopic tubes are provided with an O-ring and cap clutch assembly. The resilient O-ring clutch rests on one terminal end of the tube having the larger diameter and surrounds and grips the tube with the smaller diameter that fits there inside. Surrounding the outer, larger tube, the O-ring, and the smaller, inner tube is a cap which remains in a generally fixed relationship in regard to the outer tube. The smaller, inner tube is thus adjustable within the larger tube and the resilient O-ring keeps it in place. In this fashion, the coaxial tube may be extended to a position and remain in that position through the action of the clutch. The assembly is provided with a base support and a display carrying support.

4 Claims, 3 Drawing Sheets

ADJUSTABLE DISPLAY SUPPORT

BACKGROUND OF THE INVENTION

1. Field of the Invention

The present invention relates generally to display devices. More specifically, the present invention relates to adjustable display devices that allow the user to set the display area carrying indicia or the like at varying heights. Even more specifically, it relates to an adjustable display device wherein the adjustability of the apparatus is provided by telescopic interengagement of a pair of tubes. This device relates to an adjustable display device wherein the height setting feature of the apparatus is provided by a frictional O-ring clutch that rests at the juncture of the two tubes and is held in place by a cap.

2. Description of the Prior Art

In retail sales, it is often very useful to provide an adjustable and portable pricing guide both to inform the consumer and to draw their attention to a product. A number of adjustable signs designs have been used in this manner, allowing the height of the display to be altered, for example, when a pile of produce is restocked, or as it is sold. Most of these signs involve various mechanisms that lock and unlock, bayonet type locks being a common type. The present invention provides a display adjusting apparatus that allows the user to change the length of the tubing holding a display sign while markedly reducing the possibility of debris jamming or interfering with the smooth operation of the unit. During a search at the United States Patent and Trademark Office, a number of patents were uncovered that are relevant, and they are discussed hereinbelow:

U.S. Pat. No. 373,376 issued on Nov. 15, 1887 to William A. Penfield. This is an assembly for a standard lamp where the rods that support the lamp are adjustable in height. This is clearly dissimilar from the present invention in that there is no teaching of the O-ring clutch.

U.S. Pat. No. 1,309,375 issued on Jul. 8, 1919 to Wilton A. Taylor. This describes an electric lamp standard where the telescopic posts are held in place by a split spring clamping ring adjusted by a thumb screw or other controlling element. This is unlike the instant invention in that the novel structure of the O-ring clutch described herein needs no other additional clamps or adjustments to hold the indicia carrying portion of the display in place.

U.S. Pat. No. 1,769,004 issued on Jul. 1, 1930 to William Turse there is disclosed an adjustable lamp assembly. Various embodiments employ different resilient members to engage the tubes with one another, but there is no teaching of the present invention3 s O-ring clutch that is substantially equal to the diameter of the largest coaxially interengaged tube and that rests thereon, held in place with a cap or the like.

U.S. Pat. No. 1,924,858 issued on Aug. 29, 1933 to Leo Hopp. This discloses a price ticket holder wherein the tubular adjustment means are held in place in relationship to one another by a coiled spring. This, as in the patents mentioned above, is clearly dissimilar from the instant invention in that there is no teaching of the interrelated cap and O-ring seating assembly.

U.S. Pat. No. 2,468,160 issued on Apr. 26, 1949 to Merle K. Benson. This is a pole assembly wherein a resilient annular clutch member is used to provide adjustment means between the telescoping sections. Unlike the present invention, the O-ring clutch is not seen to rest on the end of one of the telescoping sections and, additionally, be held on place by a cooperating cap.

Lastly, U.S. Pat. No. 4,777,750 issued on Oct. 18, 1988 to Benjamin L. Garfinckle discloses a frame system for a sign holder. There is no teaching of the novel O-ring clutch assembly utilized in the instant invention.

Thus, while the foregoing body of prior art indicates it to be well known to use various devices to enhance the lights attendant to holiday decorations, the present invention does so in a novel and convenient manner. Additionally, the provision of a more simple and cost effective device as provided for in the following description of the instant invention is not contemplated in the art discussed above. Nor does the prior art described above teach or suggest an ornament backlighting device that may be detached and reattached in the simple manner described hereinafter. The foregoing disadvantages inherent in the prior art are overcome by the unique construction of the present invention as will be made apparent from the following description thereof. Other advantages of the present invention over the prior art also will be rendered evident.

SUMMARY OF THE INVENTION

To achieve the foregoing and other advantages, the present invention, briefly described, provides an improved adjustable display support wherein a pair of coaxially telescopic tubes are provided with an O-ring and cap clutch assembly. The resilient O-ring clutch rests on one end of the tube having the larger diameter and surrounds and grips the tube with the smaller diameter that fits there inside. Surrounding the outer, larger tube, the O-ring, and the smaller, inner tube is a cap that stays in a generally fixed relationship in regard to the outer tube. The smaller, inner tube is thus adjustable within the larger tube and the resilient O-ring keeps it in place. The assembly is provided with a base means and a display carrying means to allow the user to adjust the height of the display easily.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Therefore, an object of the present invention is to provide a new and improved adjustable display support that will not be jammed by debris during use.

It is still a further object of the present invention is to provide a new and improved adjustable display support wherein there are no protrusions to interfere with the raising or lowering of the display surface even if the apparatus is placed within a pile of goods or materials.

Still a further object of the present invention is to provide a new and improved adjustable display support wherein the height of the display surface is maintained by the frictional engagement of a resilient O-ring resting on the larger diameter terminal end of one of a pair of telescopically engaged tubes, the resilient ring being surrounded and held in place by a cap that maintains the ring in contact with the inner one of the telescopically engaged tubes.

It is an another object of the present invention to provide a new and improved adjustable display support which has all of the advantages of the prior art and none of the disadvantages.

It is another object of the present invention to provide a new and improved adjustable display support that may be easily and efficiently manufactured and marketed.

It is a further objective of the present invention to provide a new and improved adjustable display support that is of durable and reliable construction.

An even further object of the present invention is to provide a new and improved adjustable display support which is susceptible of a low cost of manufacture with regard to both materials and labor, and which accordingly is then susceptible of low prices of sale to the consuming public, thereby making such an adjustable display support available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved adjustable display support embodying the principles and concepts of the present invention will be described.

Figure 1:
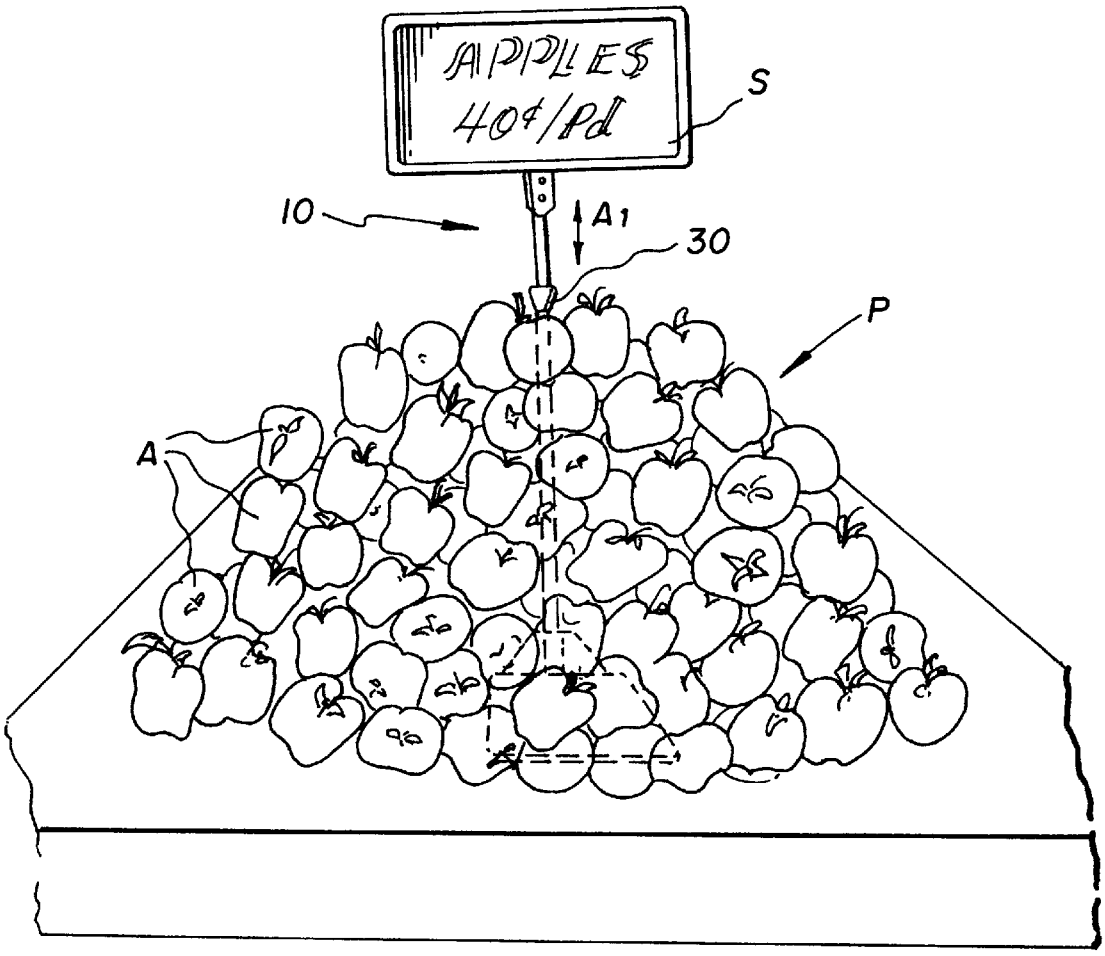
FIG. 1 is an environmental perspective view of the present invention, showing the display support being placed within a pile of material to be sold.

Turning initially to FIG. 1, there is shown an exemplary embodiment of the invention generally designated by reference numeral 10. In this figure, the invention is seen placed within a pile P of apples A for sale. One of the advantages of the present invention is that there are no protrusions or the like to either bruise or be caught on merchandise when the apparatus is being adjusted while in place. Directional arrow A1 shows the directions in which the instant invention can be adjusted as (in the case shown in the FIG. 1) the apples are restocked or sold. It will be seen further below that the present invention can be adjusted by gripping any point at or below O-ring cover 30 and then moving display portion 40 in the desired direction. This has the advantage of allowing quick and easy adjustment of the height of the sign S to maintain a neat and consistent appearance in the produce and merchandise sections of stores where the amount of stock on the shelf varies rapidly over the course of the day.

Figure 3:
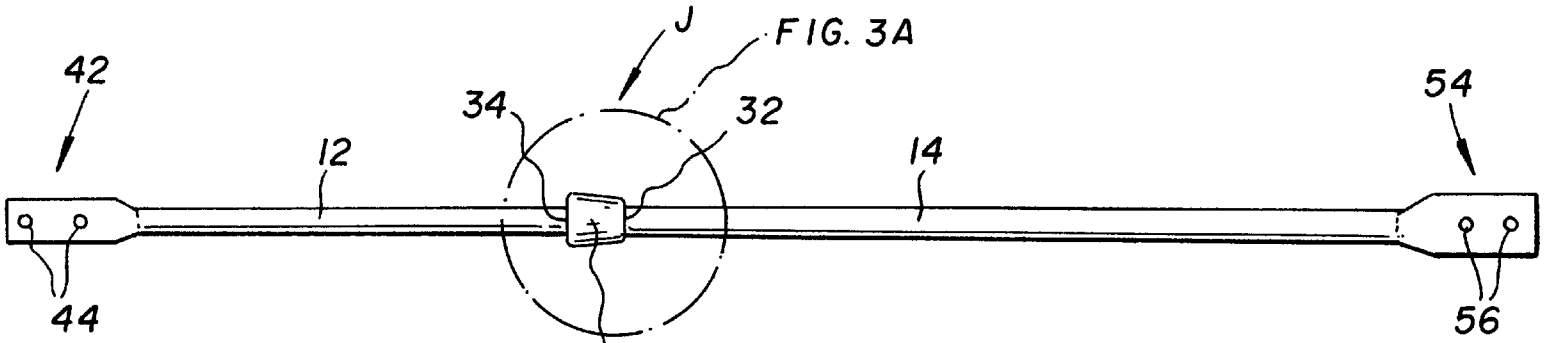
FIG. 3 is a side view of the telescopically interengaged tubes with an enlarged cutaway view showing the details of the O-ring and its cover.
Figure 3A:
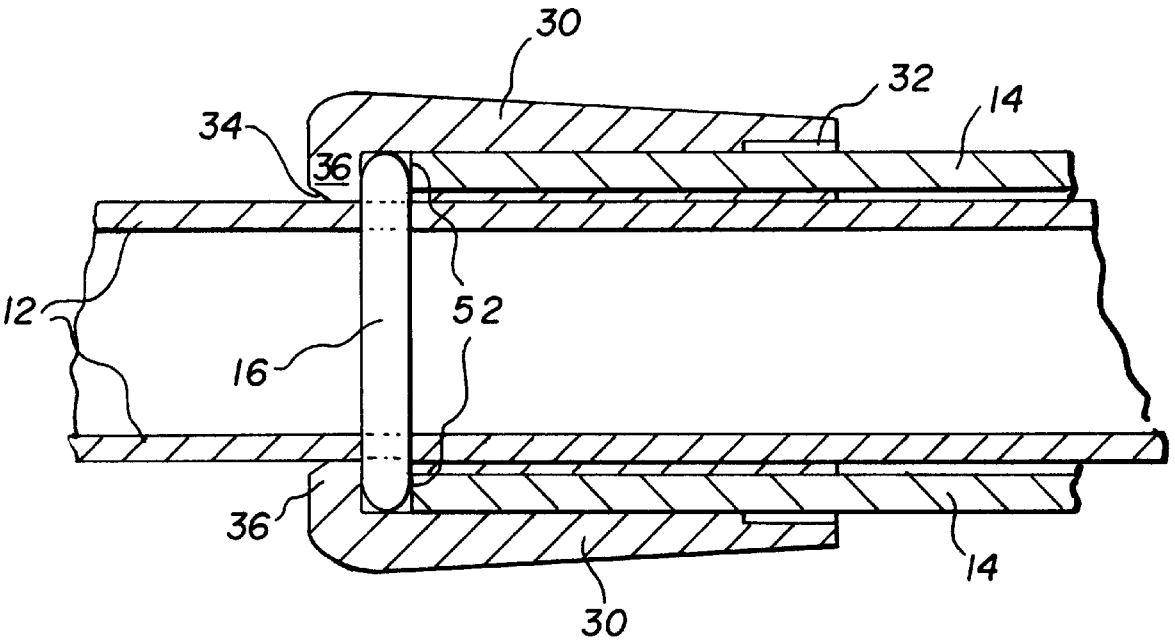

Turning to FIG. 3, the details of the novel O-ring clutch construction will be discussed. In the preferred embodiment described herein, there are a pair of telescopically interengaged tubes 12, 14. First tube 12 has a smaller diameter than second tube 14 and fits therein in such a way that the tubes 12, 14 slide smoothly in a coaxial relationship with one another. As can be seen in the enlarged cutaway portion of the Figure, resilient O-ring 16 is dimensioned and configured such that it substantially completely rests on one of the terminal ends 52 of second tube 14 and that first tube 12 fits snugly within. It should be noted that this terminal end 52 of the tube 14 has a circular cross section, in the embodiment described herein. Extending over second tube 14 proximate the junction J of the telescopically interengaged tubes and configured that it grips tube 14 firmly is O-ring cover 30. In the embodiment described herein, O-ring cover 30 has a second or larger tube receiving end 32 and a first or smaller tube receiving end 34. Proximate the first or smaller tube receiving end 34 and extending a short way towards the distal second tube receiving end is the O-ring seating flange 36. This allows the two tubes 12, 14 to moved coaxially in relation to one another and, when the adjustment by the user stops, the two tubes 12, 14 are maintained in the predetermined relationship by friction between the seated O-ring 16 and the first tube 12.

It should be noted that though the O-ring cover 30 is shown in this preferred embodiment to be a separate piece from second tube 14, it could easily be made integral therewith during the construction of the device and the resilient O-ring be placed in its seat at the same time.

Additionally, it should be noted that though the material from which resilient O-ring is not specified, a skilled practitioner would have no difficulty in finding a wide variety of materials having varying frictional coefficients to support the weight of the display portion 40 that would be contemplated in designs with different sizes and construction materials.

Figure 2:
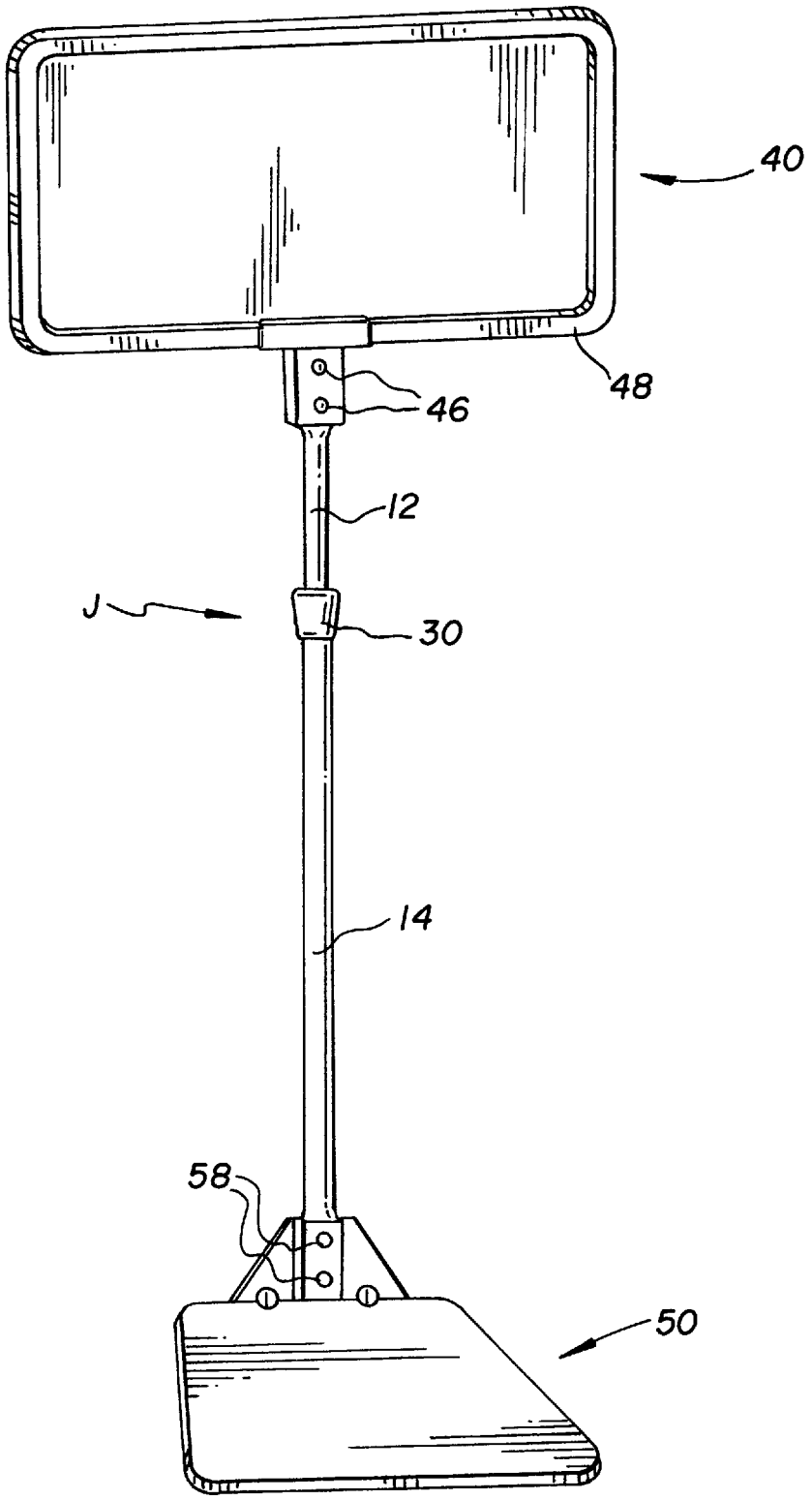
FIG. 2 is a perspective view of the invention showing more clearly the preferred base and display frame structure.

The discussion now turns to the preferred embodiment3 s base portion 50 and display portion 40. In the embodiment shown here, tube 12 has a loose terminal end (not shown) and a display support terminal end 42 (shown most clearly in FIG. 3). Display support terminal end 42 is a generally planar rectangular surface having apertures 44 that engage with display support apertures 46 (shown with threaded engagement means inserted therethrough in FIG. 2). Display support frame 48 is in turn held in place. Note that other types of display supports than are shown here could be used. Likewise, the end distal from the O-ring support terminal end 52 (indicated in FIG. 3) of tube 14 is made up of a similar base attachment terminal end 54 comprising a generally planar rectangular surface with apertures 56. These cooperate with apertures in the base 58 as seen in FIG. 2. It should be emphasized that many other types of base designs could be utilized in the practice of the present invention and that no base at all could be easily envisioned by a skilled practitioner, the novel adjustable display support being attached to a basket or other bin-type structure through various means.

The whole of the instant invention as shown in the embodiment described herein can be easily disassembled for cleaning and storage by simply pulling the two tubes 12, 14 apart, releasing the O-ring cover 30 and removing the resilient O-ring 16.

It is apparent from the above that the present invention accomplishes all of the objectives set forth by providing a new and improved adjustable display support that overcomes the disadvantages of the prior art and allows the user to easily and quickly change the height of the sign in relation to a base or support structure without fear of the apparatus jamming by the introduction of debris into the mechanism, and without fear of protrusions bruising or damaging fragile merchandise during the adjustment process.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An improved adjustable display apparatus comprising:

a base support, where said base support includes a base support tube section having a diameter and further including a terminal end having a generally circular cross section;

a display support, where said display support includes a display support tube section having a diameter dimensioned and configured such that said display support tube section fits within said base support tube section to allow telescopic interengagement therebetween;

a resilient O-ring, said O-ring dimensioned and configured such that it rests on said terminal end and when said display support tube section is fitted within said base support tube section thus allowing telescopic interengagement therebetween, said resilient O-ring firmly grips said display support tube section; and an O-ring seating means for maintaining said resilient O-ring in a substantially fixed relationship with said terminal end of said base support tube section, said seating means covering said O-ring and enclosing said terminal end, including an aperture to permit said display support to pass therethrough said O-ring seating means including a flange, wherein said resilient O-ring is located directly between said flange and said terminal end; whereby a predetermined position can be maintained through frictional interference between said resilient O-ring held by said O-ring seating means and said display support tube section when telescopic interengagement exists between said base support tube section and said display support tube section.

2. The adjustable display apparatus according to claim 1, where said O-ring seating means is a generally cylindrical portion attached to said base support tube section and including a display support tube section receiving end, and where said flange maintains said resilient O-ring in a substantially fixed relationship with said terminal end of said base support tube section.

3. The adjustable display apparatus according to claim 1, where said base support tube section further includes a base attachment means distal said terminal end.

4. The adjustable display apparatus according to claim 1, where said display support tube section further includes a display attachment means for attaching indicia carrying material.

* * * * *